United States Patent [19]

Sung

[11] Patent Number: 5,005,624

[45] Date of Patent: Apr. 9, 1991

[54] DEVICE FOR PROTECTING GOLF CLUBS

[76] Inventor: Henry H. Sung, 19826 E. Vista Hermosa Dr., Walnut, Calif. 91789

[21] Appl. No.: 323,284

[22] Filed: Mar. 14, 1989

[51] Int. Cl.[5] ..... A63B 57/00; B65D 85/20

[52] U.S. Cl. ..... 150/160; 206/315.4; 206/315.2

[58] Field of Search ..... 150/160, 159; 206/315.2, 315.4, 315.3, 315.6

[56] References Cited

U.S. PATENT DOCUMENTS

| | | | |
|---|---|---|---|
| 1,886,464 | 11/1932 | Bright | 150/160 |
| 2,128,546 | 8/1938 | Venmore | 150/160 X |
| 2,676,803 | 4/1954 | Damaske | 150/160 X |
| 2,879,819 | 3/1959 | Turnbull | 150/160 X |
| 3,145,749 | 8/1964 | Rosenow | 150/160 |
| 3,613,760 | 10/1971 | Koehnle | 150/160 |
| 3,664,399 | 5/1972 | Neff | 150/160 |
| 3,667,078 | 6/1972 | Distasio | 206/315.4 X |
| 4,195,677 | 4/1980 | Hagg et al. | 150/160 |
| 4,368,768 | 1/1983 | Cunko, Jr. | 150/160 |
| 4,497,404 | 2/1985 | Lowrance | 150/160 X |

*Primary Examiner*—Sue A. Weaver
*Attorney, Agent, or Firm*—Erik M. Arnhem

[57] ABSTRACT

A golf club protector that includes a rigid tube sized to house the shaft section of an individual golf club, and a flexible hollow cover attached to the upper end of the tube to surround (and shield) the hitting head of the club. An elongated slot-like opening is formed in the cover to permit the club head (and shaft) to be moved into or out of the protector.

3 Claims, 3 Drawing Sheets

DEVICE FOR PROTECTING GOLF CLUBS

FIELD OF THE INVENTION

This invention relates to golf accessories, particularly means for enclosing and protection a golf club against scratching.

BACKGROUND OF THE INVENTION

The number of golf clubs used in the game of golf is limited to 14 clubs and typically includes four wood clubs or "Woods"., nine iron clubs or "Irons" and one putter. The use of head covers for the protection of golf clubs when carried in a bag is well known, particularly when used in connection with the woods for protecting the clubs not only from rain and other inclement weather conditions, but also from damage due to the clubs being jostled against one another when being carried, as well as during their removal and replacement during the playing of a round of golf. The use of head covers has not been exclusively restricted to the woods since head covers have also been made which are adapted for use with "Irons" as well as putters.

Head covers are normally manufactured and sold as a numbered set, being numbered such as 1, 3, 5,—by the size and shape of the clubs to be covered. Thus, when a specific numbered head cover is lost or otherwise missing, a new set of head covers must be acquired, or otherwise matched to another set or a fixed set of various types of head covers must be resorted to. This is not only undesirable, but can result in considerable expense where the golfer desires a set of head covers of the same styling and construction.

While most head covers perform their functions satisfactorily, they do not protect the shaft and grip of the golf club from damage caused by jostling or friction.

Several patents have been issued on covers for golf club heads. U.S. Pat. No. 4,368,768 to E. Cunko shows a golf club cover attached to an upright rigid panel. The lower end of the panel has slots therethrough for reception of a belt that encircles the upper mouth of a golf bag. The cover is thus supported in an upright position above the bag.

U.S. Pat. No. 3,145,749 shows a golf club cover having a zipper extending along a substantial portion of the cover length, such that when the zipper is unzipped, the zippered edges spread apart to permit relatively easy removal of the cover from the club head. The cover is a close form-fit on the club head.

Damaske U.S. Pat. No. 2,676,803 shows a form-fitting club head cover having a zipper fastener extending along the hitting face of the club head and a portion of the club shaft. The principal feature of the patent appears to be a pocket structure for containment of a weight member.

The various patents do not appear to show mechanisms for protecting both the heads and shafts of golf clubs.

SUMMARY OF THE INVENTION

Accordingly, it is an object of the present invention to provide an improvement in protecting golf clubs, not only the heads of the clubs but the shafts of the clubs and the grips of the clubs. The club head covering portion of the protector is connected to an elongated rigid tubular housing formed with a closed lower end. Individual golf club protectors are arranged within a golf bag for containment of the clubs during storage and while playing the golf game.

DESCRIPTION OF THE DRAWING

While the present invention is defined in the claims annexed to and forming a part of this specification, a better understanding of the invention can be had by reference to the following description taken in conjunction with the accompanying drawings in which:

DESCRIPTION OF THE PREFERRED EMBODIMENT

Figure 1:
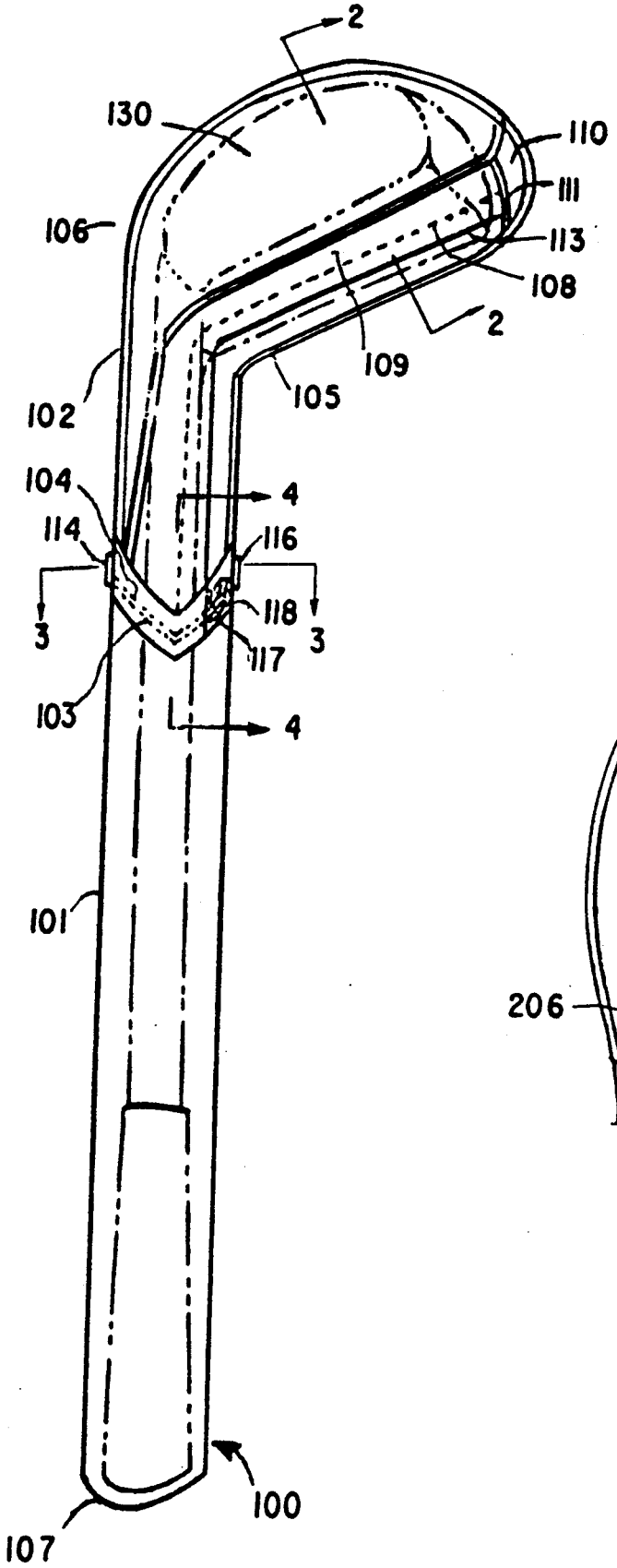
FIG. 1 is a perspective view of a golf club enclosure for a wood club, constructed according to the invention.

Referring now to FIG. 1, shown thereat is a wood club enclosure in accordance with the subject invention and which is identified by reference numeral 100. The wood club enclosure 100 is comprised of club shaft adapter tube 101 and club head cover 102. The club shaft adapter tube 101 is an elongated tubular form made of rigid materials, with upper end 103 having an oval shaped section resulting from a 45 degree cut slant from perpendicular line of tube 101, and the lower end 107 being closed. Tube 101 has sufficient length to house the shaft section of the golf club, including the handgrip portion thereof. Tube 101 can have a square cross section. However the preferred tube cross section is circular. The internal diameter of tube 101 will be slightly larger than the major cross sectional dimension of the golf club hand grip; there will be an annular clearance between the shaft and the tube inner surface at the upper mouth end 103 of the tube.

Figure 2:
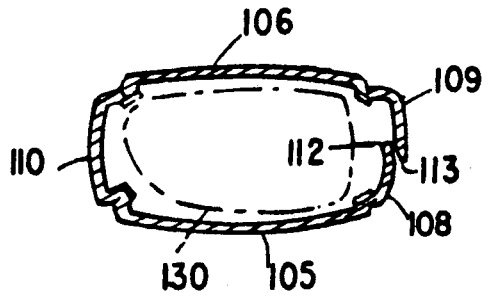
FIG. 2 is a sectional view of a wood club head cover taken on line 2 in FIG. 1.

Club head cover 102 is formed of panels of leather or similar flexible materials. The materials should have a certain stiffness so that the cover can maintain its shape and assume an upright attitude extending upwardly from rigid tube 101. The various panels used to form flexible cover 102 can be formed separately and sewn together. The cover 102 shown in FIG. 1 comprises a top panel 106, a bottom panel 105, a back panel 110, and two front panels 108 & 109. All of these panels are sewn together in order to cover up wood club head 130 having a quarter of an inch over-sized material all around the surface of the club head. The "L" shaped front panels 108 & 109 overlap; edge 112 of panel 108 is located inside of edge 113 of panel 109 (FIG. 2). The overlapped area of the panels is left openable and forms a curved long opening extending along the entire distance from seam 111 of back panel 110 to the upper end 103 of tube 101 (FIG. 1).

The open end 104 of head cover 102 is cut to match or coincide with the oval shaped upper end 103 of tube 101 for interconnection therebetween. Rivets 114, 115 and 116 are the means used to attach head cover 102 to tube 101 with the open end 104 of cover 102 overlapping the upper end 103 of tube 101 (FIG. 3).

Figure 4:
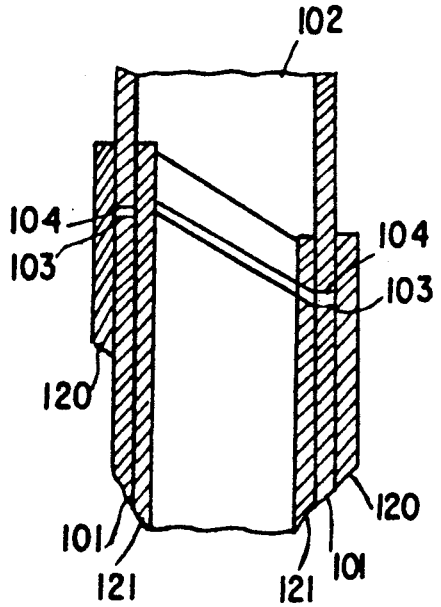
FIG. 4 is a sectional view of a joined golf club head cover and club shaft enclosure taken on line 4 in FIG. 1.

Alternatively, a flexible tube 120, made of same material as cover 102 can overlap thin lining tube 121, and these tubes are attached to open end 104 of head cover 102, and then, rigid tube 101 is inserted between tubes 120 and 121 (FIG. 4).

Figure 3:
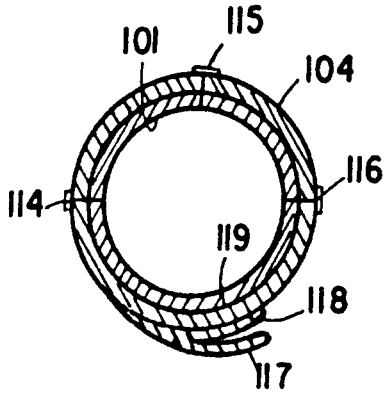
FIG. 3 is a sectional view of a golf club joined head cover and club shaft enclosure taken on line 3 in FIG. 1.

Fastening tapes 117, 118 and 119 consisting of a multiplicity of small flexible plastic hooks on one tape mating with an oppositely located tape of small loops commercially sold under the trademark Velcro attached to the open end 104 of head cover 102, as shown in FIG. 3. The fastener 117 will engage fastener 118 when the clubs are to be stored; when a golf game is in progress fastener 117 can engage fastener 119 when open end 104 is turned inside out so as to widen the opening for the easy insertion into or removal of clubs from enclosure 100. Snap buttons could be used instead of said fasteners.

Figure 5:
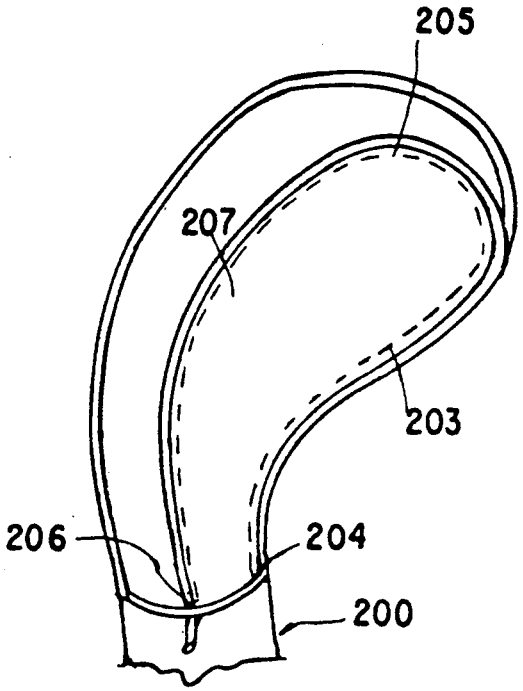
FIG. 5 is a perspective view of another wood club enclosure, according to the invention.

FIG. 5 illustrates a golf club protector 200 that is quite similar to the structure shown in FIG. 1, except that the slot opening is formed along the peripheral edge of a bottom panel 207. The slot opening is closed by a zipper 203 that extends upwardly from point 204, around toe area 205, and back down to point 206. The slot opening covered by zipper 203 circumscribes a flap-like panel 207 that can be swung downwardly to expose the club head for withdrawal from the protector device. The nature of flap 207 is such that the associated rigid tube can extend further up on the club shaft, compared to tube 101 shown in FIG. 1. The flexible cover is slightly smaller (shorter) than cover 102, while still having an L-configuration.

Figure 6:
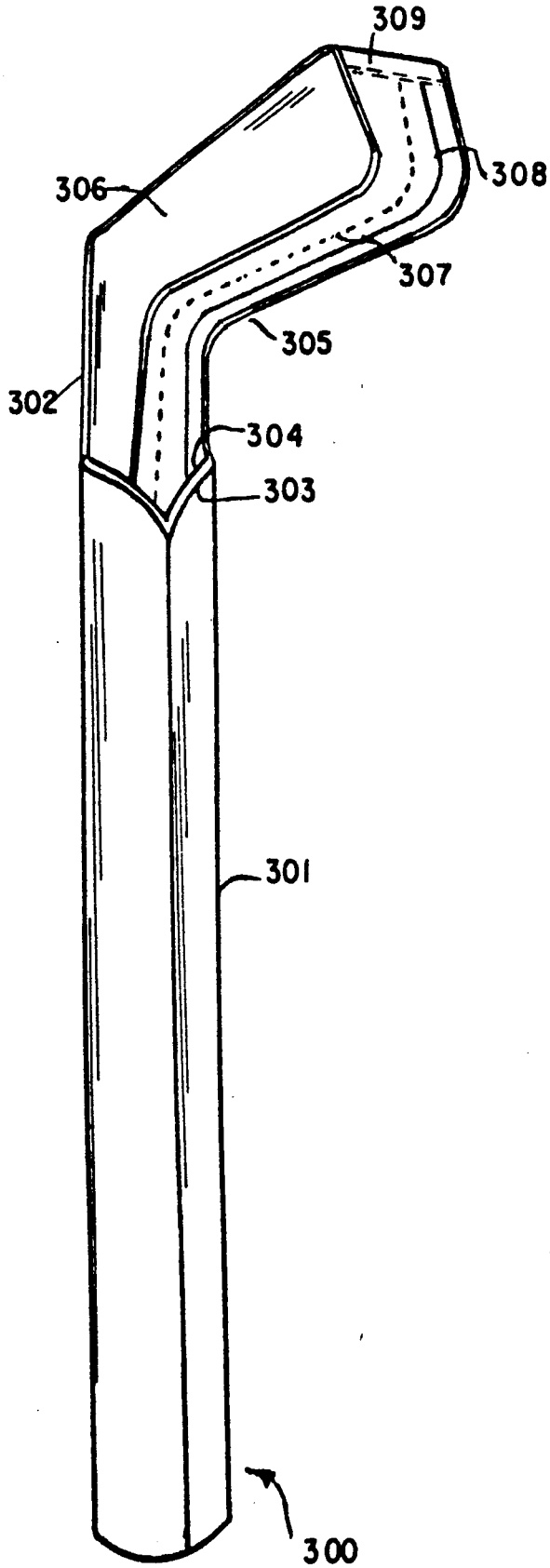
FIG. 6 is a perspective view of an iron club enclosure according to the invention.

FIG. 6 shows a construction of an iron club enclosure being identified by numeral 300. The construction of iron club enclosure 300 is similar to wood club enclosure 100 in FIG. 1, except that the head cover section 302 is sized to mate (surround) an iron club, rather than a wood club. The upper end 303 of rigid tube 301 is connected to the open end 304 of head enclosure 302.

Iron head 302 is comprised of two side panels 305 and 306, two front panels 307 & 308, and top panel 309. An elongated curved opening is provided by the overlapping front panels 307 & 308.

Figure 7:
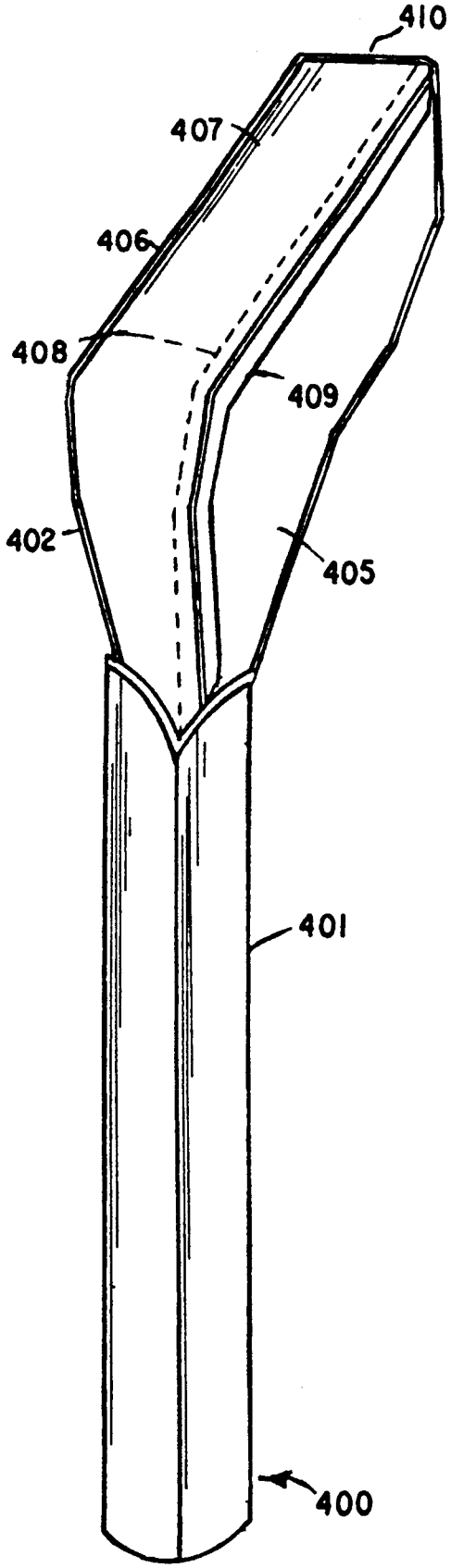
FIG. 7 is a perspective view of a putter enclosure, according to the invention.

FIG. 7 shows a putter enclosure which is identified by numeral 400. The construction of putter enclosure 400 is similar to wood club enclosure 100 in FIG. 1, except that the head cover section 402 is sized to enclose a putter head. The upper end of tube 401 is connected to the lower open end of head cover 402. Head cover 402 is comprised of two side panels 405 & 406, a top panel 407, and interior collar 408, an outer collar 409 and a back panel 410. The outer collar 409 overlaps interior collar 408 and a curved elongated opening is provided.

The drawings show protectors for golf clubs, wherein the individual golf club is stored in an inverted position, with the shaft section thereof extending downwardly within a rigid protector tube 101 (or 301, or 401). The club head is housed within a flexible cover that is secured to the upper end of the rigid tube. The cover has an elongated slot-like opening therein sized to have the club head pass therethrough when the club is withdrawn from the rigid tube; the tube and flexible cover remain in the golf bag so that they cannot be lost or mislaid. Individual clubs are housed within individual protectors so that they cannot strike against one another or assume oblique crossed positions taking up excess space. Use of such individual protectors may permit some reduction in the gold bag size, due to the fact that the clubs have predetermined parallel spaced attitudes within the bag. Each club is protected from the weather elements and from being scratched by contact with other clubs. The clubs can be arranged in an orderly fashion, e.g. No. 1 iron, No. 2 iron, etc., for easy selection when needed.

I claim:

1. A golf club protector comprising an elongated rigid tube adapted to assume a vertical position in a golf bag for housing the shaft of an inverted golf club; and a flexible cover secured to the upper end of said rigid tube to entirely surround the hitting head of the inverted golf club; said flexible cover comprising first and second generally parallel elongated flexible panels (105 and 104) configured to be slightly larger than the profile of the inverted golf club head; a third elongated flexible panel (110) extending between longitudinal edge areas of the first and second panels; said third panel having an upper end area adapted to extend along the toe area of the golf club head, a central area adapted to extend along the sole area of the club head, and a downwardly extending area connected to the upper end of the rigid tube; a fourth flexible panel (108) extending from the other longitudinal edge of the first panel partway across the space between the first and second panels; and a fifth flexible panel (109) extending from the other longitudinal edge of the second panel partway across the space between the second and first panels; said fourth and fifth panels having confronting overlapped unconnected longitudinal edges that define a longitudinal slot extending along the undersurface of the club head cover; said longitudinal slot having a sufficient length as to expose the golf club head when the cover is pulled in a direction away from the fourth and fifth panels.

2. The golf club protector of claim 1 wherein upper end edges of said fourth and fifth panels are joined (at 111) to the upper end edge of said third panel; the lower end edges of said fourth and fifth panels being connected to the upper end of said rigid tube, so that the longitudinal slot extends substantially the entire distance from the upper end edge of the third panel to the upper end of the rigid tube.

3. The golf club protector of claim 2 wherein each of said first and second panels has an L configuration.

* * * * *